US007873460B2

(12) United States Patent
Nakata et al.

(10) Patent No.: US 7,873,460 B2
(45) Date of Patent: Jan. 18, 2011

(54) CONTROLLER FOR FUEL INJECTION SYSTEM

(75) Inventors: Kenichiro Nakata, Anjo (JP); Koji Ishizuka, Chita-gun (JP)

(73) Assignee: Denso Corporation, Kariya (JP)

( * ) Notice: Subject to any disclaimer, the term of this patent is extended or adjusted under 35 U.S.C. 154(b) by 352 days.

(21) Appl. No.: 12/210,440

(22) Filed: Sep. 15, 2008

(65) Prior Publication Data

US 2009/0082941 A1 Mar. 26, 2009

(30) Foreign Application Priority Data

Sep. 25, 2007 (JP) ..... 2007-246498
May 22, 2008 (JP) ..... 2008-133974

(51) Int. Cl.
*F02D 41/40* (2006.01)
*F02M 47/02* (2006.01)

(52) U.S. Cl. ..... 701/103; 123/457

(58) Field of Classification Search ..... 701/103–105, 701/110, 115; 123/456, 457, 447, 445, 480; 73/114.43, 114.51
See application file for complete search history.

(56) References Cited

U.S. PATENT DOCUMENTS 5,044,342 A * 9/1991 Yamane et al. ..... 123/480
5,723,780 A * 3/1998 Miwa et al. ..... 701/104
6,105,554 A * 8/2000 Nishiyama ..... 123/436
6,142,121 A 11/2000 Nishimura et al.
6,526,948 B1 * 3/2003 Stavnheim et al. ..... 123/497
7,389,767 B2 * 6/2008 Kasbauer et al. ..... 123/457

FOREIGN PATENT DOCUMENTS

JP 08-061133 3/1996
JP 2000-265892 9/2000

OTHER PUBLICATIONS

U.S. Appl. No. 11/930,668 of Ishizuka, filed Oct. 31, 2007.
U.S. Appl. No. 12/179,235 of Ishizuka, filed Jul. 24, 2008.
U.S. Appl. No. 12/186,038 of Nakata, filed Aug. 5, 2008.
U.S. Appl. No. 12/187,638 of Nakata, filed Aug. 7, 2008.
U.S. Appl. No. 12/189,376 of Nakata, filed Aug. 11, 2008.
U.S. Appl. No. 12/194,917 of Nakata, filed Aug. 20, 2008.
U.S. Appl. No. 12/195,609 of Nakata, filed Aug. 21, 2008.
U.S. Appl. No. 12/194,130 of Nakata, filed Aug. 19, 2008.
U.S. Appl. No. 12/197,447 of Nakata, filed Aug. 25, 2008.
U.S. Appl. No. 12/201,426 of Nakata, filed Aug. 29, 2008.
Japanese Office Action dated Aug. 28, 2009, issued in corresponding Japanese Application No. 2008-133974, with English translation.

(Continued)

*Primary Examiner*—Hieu T Vo
(74) *Attorney, Agent, or Firm*—Nixon & Vanderhye PC

(57) ABSTRACT

A fuel pressure sensor is provided to each fuel injector respectively and is disposed in a fuel passage between the accumulator and a fuel injection port of the fuel injector in such a manner as to be close to a fuel injection port relative to the accumulator. Output values of a plurality of fuel pressure sensors are acquired, and an average of the output values is computed. The output values are corrected in such a manner as to agree with the average.

12 Claims, 7 Drawing Sheets

OTHER PUBLICATIONS

U.S. Appl. No. 12/210,409, Koji Ishizuka et al., filed Sep. 15, 2008.
U.S. Appl. No. 12/233,800, Kenichiro Nakata et al., filed Sep. 19, 2008.
U.S. Appl. No. 12/235,917, Kenichiro Nakata et al., filed Sep. 23, 2008.
U.S. Appl. No. 12/236,882, Koji Ishizuka et al., filed Sep. 24, 2008.
U.S. Appl. No. 12/255,936, Koji Ishizuka et al., filed Oct. 22, 2008.
U.S. Appl. No. 12/256,100, Koji Ishizuka et al., filed Oct. 22, 2008.
U.S. Appl. No. 12/258,726, Koji Ishizuka et al., filed Oct. 27, 2008.
U.S. Appl. No. 12/258,750, Koji Ishizuka et al., filed Oct. 27, 2008.

* cited by examiner

CONTROLLER FOR FUEL INJECTION SYSTEM

CROSS-REFERENCE TO RELATED APPLICATION

This application is based on Japanese Patent Applications No. 2007-246498 filed on Sep. 25, 2007, and No. 2008-133974 filed on May 22, 2008, the disclosures of which are incorporated herein by reference.

FIELD OF THE INVENTION

The present invention relates to a controller which controls an operation of a fuel injection system, such as a common-rail system.

BACKGROUND OF THE INVENTION

As shown in JP-10-220272A (U.S. Pat. No. 6,142,121), in a common rail type fuel injection system constructed of this fuel injection apparatus, fuel pressure-fed from a fuel pump is accumulated in a high-pressure state by a common rail. Then, the accumulated high-pressure fuel is supplied to the fuel injection valve of each cylinder through pipes (high-pressure fuel passage) disposed for each cylinder. The common rail is provided with a fuel pressure sensor (rail pressure sensor). This system is constructed in such a way as to control various devices constructing a fuel supply system on the basis of the output of the rail pressure sensor.

The output value of the rail pressure sensor is converted into the pressure. However, this converted pressure does not always agree with an actual pressure value. That is, the pressure converted from the output value may deviate from an actual pressure value due to an individual difference of the fuel pressure sensor, which is caused by a manufacturing error or a designing error. Even if the fuel pressure deviates from the actual pressure values such a deviation is not compensated in a conventional fuel injection system. Robustness with respect to the output value is not enough. The fuel injection system is not accurately controlled.

SUMMARY OF THE INVENTION

The present invention is made in view of the above matters, and it is an object of the present invention to provide a controller for a fuel injection system which improves its robustness with respect to an output value of a fuel pressure sensor, whereby the fuel injection system is accurately controlled by use of the output value of the fuel pressure sensor.

According to the present invention, a fuel injection system includes an accumulator for accumulating a fuel therein, a plurality of fuel injectors for injecting the fuel accumulated in the accumulator, and a fuel pressure sensor detecting a fuel pressure which varies due to a fuel injection by the fuel injector. A controller controls the fuel injection system by use of an output value of the fuel pressure sensor. The fuel pressure sensor is provided to each fuel injector respectively and is disposed in a fuel passage between the accumulator and a fuel injection port of the fuel injector in such a manner as to be close to a fuel injection port relative to the accumulator. The controller includes an output acquiring means for acquiring output values of a plurality of fuel pressure sensors; an average computing means for computing an average of the output values, and an output value correction means for correcting the output values in such a manner as to come close to the average.

The fuel pressure sensor is respectively provided to each of fuel injectors. An average of the output values of the fuel pressure sensors is computed. A deviation amount of the average from an actual pressure is smaller than a deviation amount of each output value from the actual pressure. Thus, the output value of the fuel pressure sensor is corrected so that the output value comes close to the average. Robustness with respect to the output value of the fuel pressure sensor can be improved, and the fuel injection system can be accurately controlled.

According to another aspect of the present invention, a fuel injection system includes an accumulator for accumulating a fuel therein, a plurality of fuel injectors for injecting the fuel accumulated in the accumulator, and a fuel pressure sensor detecting a fuel pressure which varies due to a fuel injection by the fuel injector. The controller controls the fuel injection system by use of an output value of the fuel pressure sensor. The fuel pressure sensor is provided to each fuel injector respectively and is disposed in a fuel passage between the accumulator and a fuel injection port of the fuel injector in such a manner as to be close to a fuel injection port relative to the accumulator. The controller includes: an output acquiring means for acquiring output values of a plurality of fuel pressure sensors; an average computing means for computing an average of the output values, and an abnormality determination means which determines that the output value of the fuel pressure sensor is abnormal when a difference between the output value of the fuel pressure sensor and the average is greater than a predetermined threshold.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
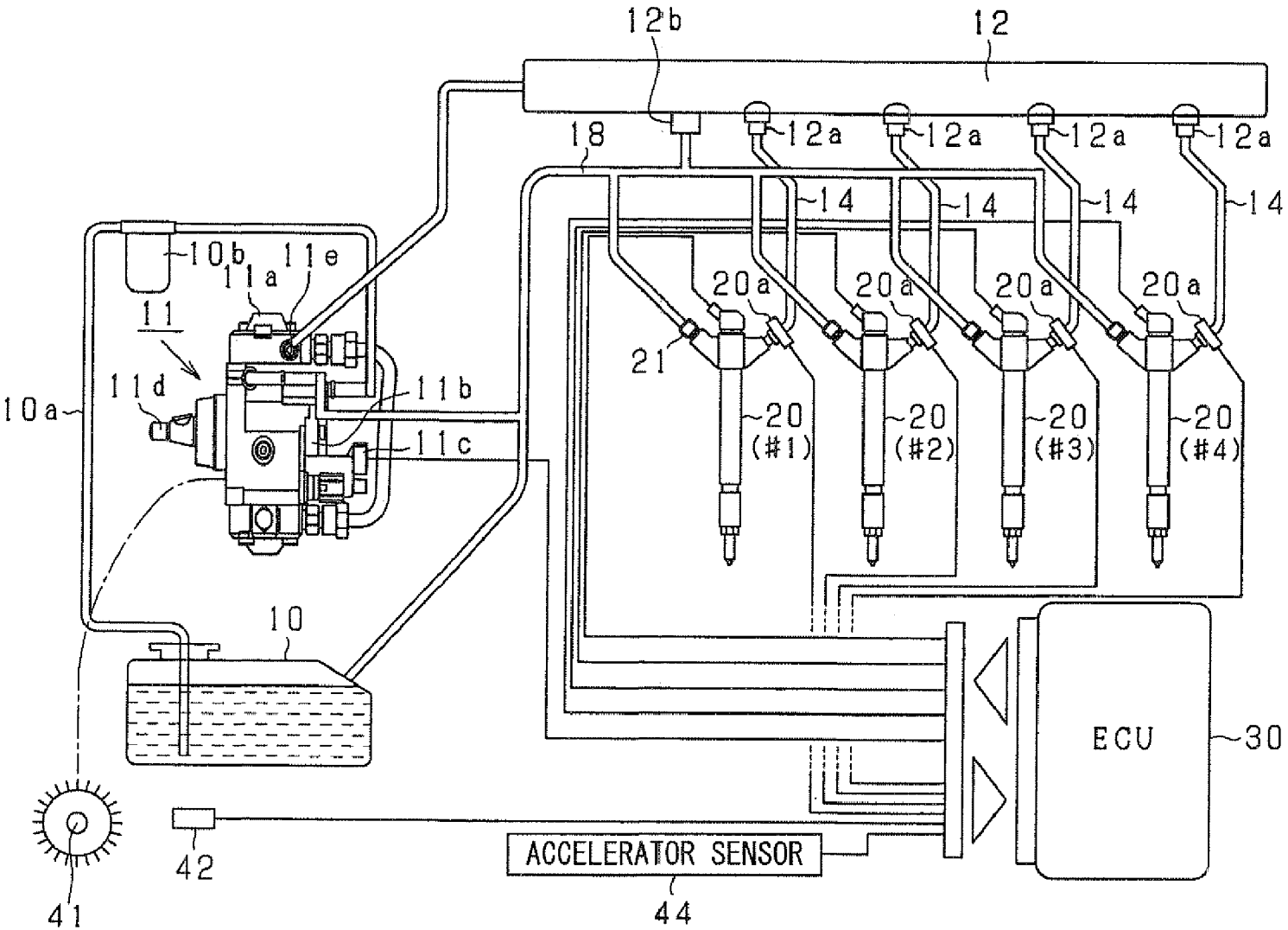
FIG. 1 is a construction diagram to show an outline of a common rail type fuel injection system in an embodiment of the invention.

Hereinafter, an embodiment that embodies the present invention will be described with reference to the drawings. In this embodiment, a controller is mounted on a common rail type fuel injection system applied to an internal combustion engine. The engine is a diesel engine. High pressure fuel (for example, light oil of 1000 atmospheres or more) is directly injected into a combustion chamber of the diesel engine.

The outline of the common rail type fuel injection system according to this embodiment will be described with reference to FIG. 1. A multi-cylinder engine (for example, inline four-cylinder engine) for a four-wheel automobile is assumed as the engine of this embodiment. More specifically, the engine is a four-stoke reciprocal diesel engine. In this engine, an object cylinder is successively distinguished by a cylinder discrimination sensor (electromagnetic pickup) provided in camshafts of the intake-exhaust valves. That is, one combustion cycle including 4 strokes of intake, compression, power, and exhaust is performed in sequence at a cycle of "720° CA" with respect to each of four cylinders #1-#4. The combustion is performed in the cylinder #1, #3, #4, and #2 in this series with a deviation of 180° CA. The fuel injectors 20 (fuel injector) in the FIG. 1 are for cylinders #1, #2, #3, and #4 from left side.

The various devices constructing the fuel supply system include a fuel tank 10, a fuel pump 11, a common-rail 12 (accumulator), and injectors 20 which are arranged in this order from the upstream side of fuel flow. The fuel tank 10 and the fuel pump 11 are connected to each other by piping 10*a* via a fuel filter 10*b*. The fuel tank 10 is a tank (container) for storing the fuel (light oil) of a target engine.

As shown in FIG. 1, this system is constructed in such a way that an electronic control unit (ECU) 30 receives sensor outputs (detection results) from various sensors and controls the driving of a fuel supply apparatus, such as injectors 20 and the fuel pump 11, on the basis of these respective sensor outputs.

The fuel pump 11 includes a high-pressure pump 11*a* and a low-pressure pump 11*b* and is constructed in such a way that the fuel suctioned from the fuel tank 10 by the low-pressure pump 11*b* is pressurized and discharged by the high-pressure pump 11*a*. The quantity of fuel pressure-fed to the high-pressure pump 11*a*, that is, the quantity of fuel discharged by the fuel pump 11 is controlled by a suction control valve (SCV) 11*c* disposed on the fuel suction side of the fuel pump 11. In other words, the driving current of the SCV 11*c* is adjusted to control the quantity of discharge of the fuel from the fuel pump 11 to a desired value. The SCV 11*c* is a normally open valve that is opened when the current is not passed.

The low-pressure pump 11*a* is constructed, for example, as a trochoidal feed pump. The high-pressure pump 11*a* is constructed, for example, of a plunger pump and is constructed in such a way that a specific number of plungers (for example, 2 or 3 plungers) are reciprocated respectively in an axial direction by an eccentric cam (not shown) to pressure-feed the fuel in a pressuring chamber at specific timing sequentially. Both pumps are driven by a drive shaft 11*d*. The drive shaft 11*d* is rotated in association with a crankshaft 41 of the engine and is rotated, for example, at a ratio of 1/1 or 1/2 with respect to one rotation of the crankshaft 41. That is, the low-pressure pump 11*b* and the high-pressure pump 11*a* are driven by the output of the engine.

The fuel in the fuel tank 10 is suctioned by the fuel pump 11 via a fuel filter 10*b* and is pressurized and fed (pressure-fed) to the common-rail 12 through a piping. The common-rail 12 stores the fuel in a high pressure state, and performs a fuel distribution to the injector 20 of each cylinder #1-#4 through the high pressure piping 14 respectively. A fuel exhaust port 21 of each injector 20 (#1-#4) is connected to a piping 18 for returning excessive fuel to the fuel tank 10. Moreover, between the common-rail 12 and the high pressure piping 14, there is provided an orifice 12*a* (fuel pulsation reducing means) which attenuates pressure pulsation of the fuel which flows into the high pressure piping 14 from the common-rail 12.

The common-rail 12 is provided with a pressure reducing valve 12*b*. When it is controlled so that the pressure reducing valve 12*b* is opened by the ECU 30, a part of fuel in the common-rail 12 is returned to the fuel tank 10 through the piping 18. Therefore, the fuel pressure in the common-rail 12 is decreased.

Figure 2:
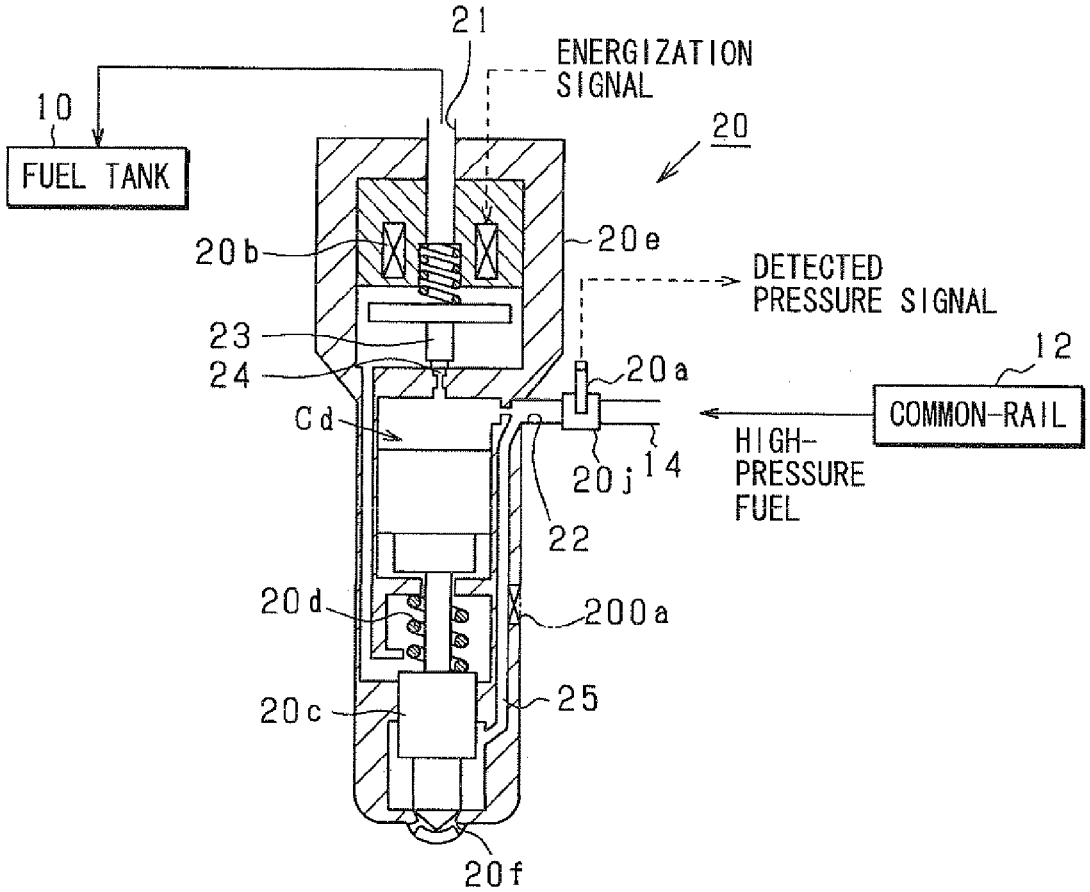
FIG. 2 is an internal side view to schematically show an internal structure of an injector.

The structure of the injector 20 will be described in detail with reference to FIG. 2. The above four injectors 20 (#1-#4) have fundamentally same structure. The injector 20 is an injector of the oil-pressure drive type using the fuel for combustion (fuel in the fuel tank 10), and a driving force for fuel injection is transferred to the valve portion through an oil pressure chamber (control chamber) Cd. As shown in FIG. 2, the injector 20 is a normally-closed valve.

A housing 20*e* of the injector 20 has a fuel inlet 22 through which the fuel flows from the common-rail 12. A part of the fuel flows into the oil pressure chamber Cd and the other flows toward the fuel injection port 20*f* through the fuel inlet 22. The oil pressure chamber Cd is provided with a leak hole 24 which is opened/closed by a control valve 23. When the leak hole 24 is opened, the fuel in the oil pressure chamber Cd is returned to the fuel tank 10 through the leak hole 24 and a fuel discharge port 21.

When a solenoid 20*b* is energized, the control valve 23 is lifted up to open the leak hole 24. When the solenoid 20*b* is deenergized, the control valve 23 is lifted down to close the leak hole 24. According to the energization/deenergization of the solenoid 20*b*, the pressure in the oil pressure chamber Cd is controlled. The pressure in the oil pressure chamber Cd corresponds to a back pressure of the needle valve 20*c*. A needle valve 20*c* is lifted up or lifted down according to the pressure in the oil pressure chamber Cd, receiving a biasing force from a spring 20*d*. When the needle valve 20*c* is lifted up, the fuel flows through the fuel supply passage 25 and is injected into the combustion chamber through the injection port 20*f*.

The needle valve 20*c* is driven by an on-off control. That is, the solenoid 20*b* receives a pulse signal from the ECU 30 to drive the needle valve 20*c*. When the solenoid 20*b* receives ON signal, the needle valve 20*c* is lifted up to open the injection port 20*f*. When the solenoid 20*b* receives OFF signal, the needle valve 20*c* is lifted down to close the injection port 20*f*.

The pressure in the oil pressure chamber Cd is increased by supplying the fuel in the common-rail 12. On the other hand, the pressure in the oil pressure chamber Cd is decreased by energizing the solenoid 20*b* to lift up the control valve 23 so that the leak hole 24 is opened. Thereby, the fuel in the oil pressure chamber Cd is returned to the fuel tank 10 through the piping 18 which connects the injector 20 with the fuel tank 10. That is, the fuel pressure in the oil pressure chamber Cd adjusted by the control valve 23 controls the operation of the needle valve 20*c* which opens/closes the fuel injection port 20*f*.

As described above, the injector 20 is provided with a needle valve 20*c* which opens/closes the injector 20. When the solenoid 20*b* is deenergized, the needle valve 20*c* is moved to a closed-position by a biasing force of the spring 20*d*. When the solenoid 20*b* is energized, the needle valve is moved to an open-position against the biasing force of the spring 20*d*. The lift amount of the needle valve 20*c* is symmetrically varied in opening direction and closing direction.

A fuel pressure sensor 20*a* is disposed at a vicinity of the fuel inlet 22. Specifically, the fuel inlet 22 and the high pressure piping 14 are connected with each other by a connector 20*j* in which the fuel pressure sensor 20*a* is disposed.

The fuel pressure sensor 20*a* detects fuel pressure at the fuel inlet 22 at any time. Specifically, the fuel pressure sensor 20*a* can detect a variation pattern of the fuel pressure due to the fuel injection, a fuel pressure level (stable pressure), a fuel injection pressure, and the like.

The fuel pressure sensor 20*a* is provided to each of the injectors 20 (#1-#4). Based on the outputs of the fuel pressure sensor 20*a*, the variation pattern of the fuel pressure due to the fuel injection can be detected with high accuracy.

The vehicle (not shown) is provided with various sensors for vehicle control. For example, a crankshaft 41 that is the output shaft of the engine is provided with a crank angle sensor 42 (for example, an electromagnetic pick-up) for outputting a crank angle signal at intervals of a specific crank angle (for example, at intervals of 30° CA) so as to detect the rotational angle position and the rotation speed of the crankshaft 41. An accelerator pedal (not shown) is provided with an accelerator sensor 44 for outputting an electric signal according to the state (quantity of displacement) of the accelerator pedal so as to detect the quantity of operation of the accelerator pedal (stepped amount of the accelerator) by a driver.

The ECU 30 performs the engine control in this system. The ECU 30 is constructed of a well-known microcomputer (not shown) and grasps the operating state of the engine and user's request on the basis of the detection signal of various sensors and operates various actuators such as the injector 20 and the SCV 11*c*.

A microcomputer of the ECU 30 includes a central processing unit (CPU), a random access memory (RAM), a read only memory (ROM), an electrically erasable programmable read-only memory (EEPROM), a backup RAM, and the like. The ROM stores a various kind of programs for controlling the engine, and the EEPROM stores a various kind of data such as design date of the engine.

The ECU 30 computes a torque (required torque) which should be generated on an output shaft (a crank shaft 41) and a fuel injection quantity to obtain the required torque based on the outputs from the sensors. The fuel injection quantity is controlled so that an axial torque (output torque) which is actually generated on the crank shaft 41 agrees with the required torque.

That is, the ECU 30 computes the fuel injection quantity according to an engine driving condition and the accelerator operation amount. The ECU 30 outputs a fuel injection control signal to the injector 20. Hence, the output torque of the engine is brought to the target torque.

Besides, in the diesel engine of steady operation, the intake throttle valve is held at the approximate full open state in order to increase fresh air quantity and reduce pumping loss. Thus, the fuel injection quantity control is mainly performed.

Figure 3:
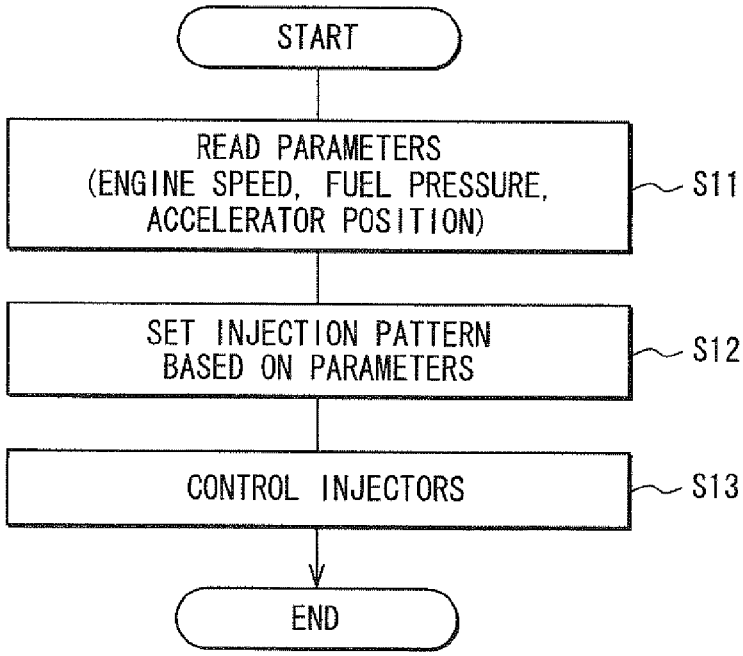
FIG. 3 is a flow chart to show a basic procedure of a fuel injection control processing.
Figure 4:
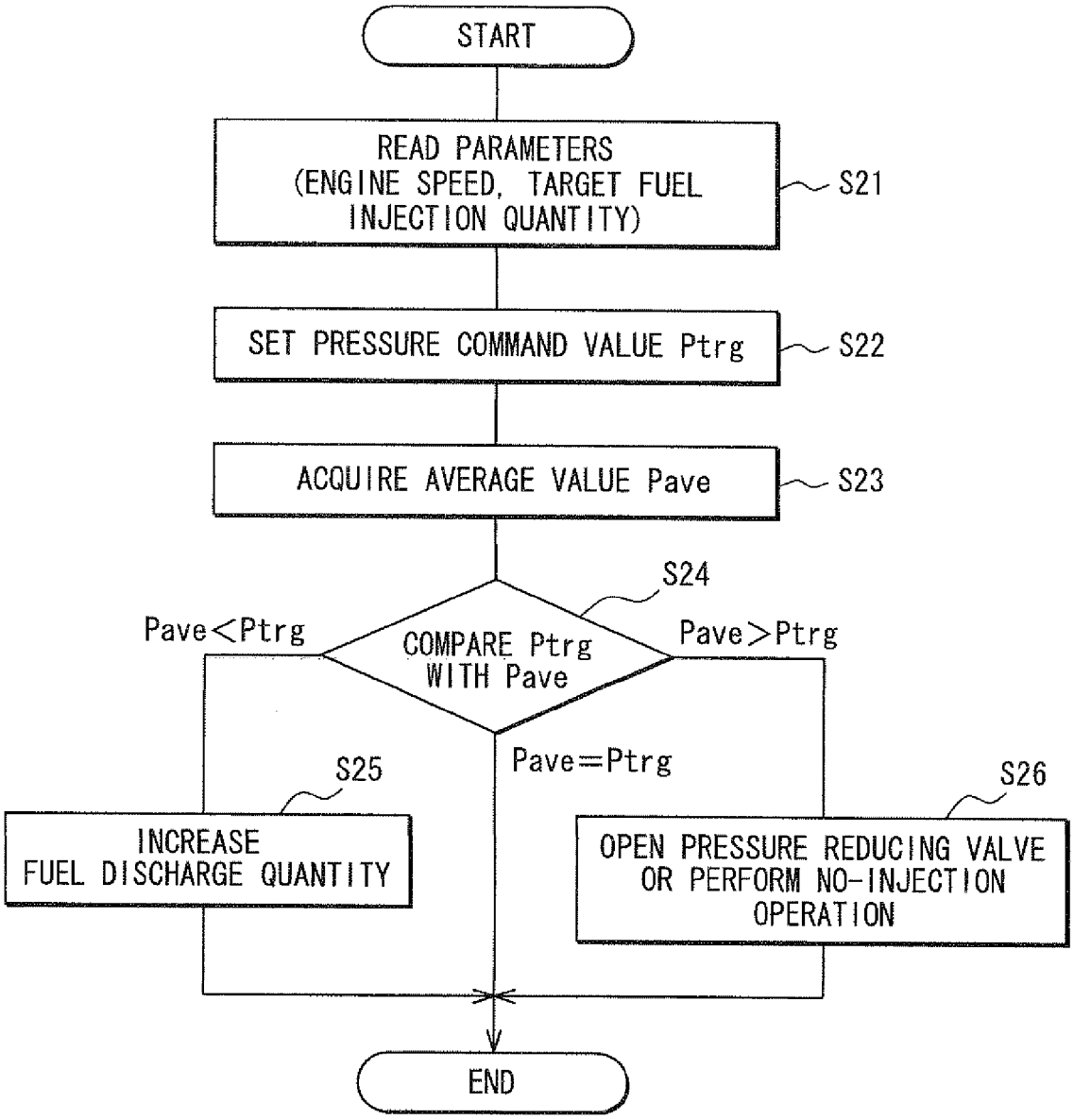
FIG. 4 is a flow chart to show a procedure of a fuel pressure control processing.
Figure 5:
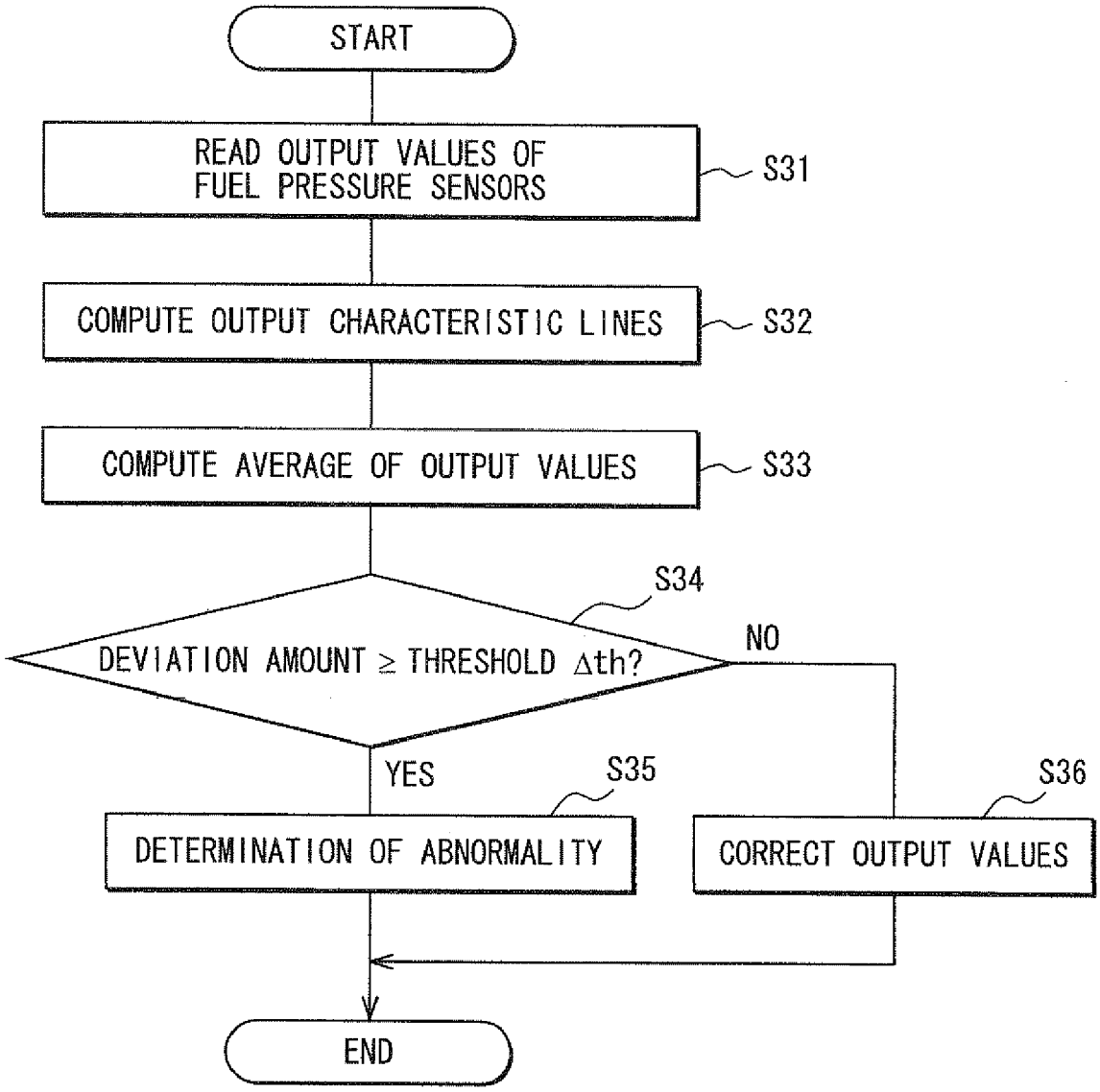
FIG. 5 is a flow chart to show a procedure of an output value correction processing and an abnormality determination processing.

Hereinafter, the basic procedure of the fuel injection control according to this embodiment will be described with reference to FIGS. 3-5. The values of various parameters used in these processings shown in FIGS. 3-5 are stored in the storage devices such as the RAM, the EEPROM, or the backup RAM mounted in the ECU 30 and are updated at any time as required. The processings are performed based on programs stored in the ROM.

The processing shown in FIG. 3 is performed once per one combustion cycle with respect to each cylinder. In step S11 the computer reads specific parameters, such as the engine speed measured by the crank angle sensor 42, the fuel pressure detected by the fuel pressure sensor 20*a*, and the accelerator position detected by the accelerator sensor 44.

In step S12, the computer sets the injection pattern based on the parameters which are read in step S11. In a case of a single injection, a target fuel injection quantity (target fuel injection time) is determined to generate the required torque on the crankshaft 41. In a case of a multi-injection, a target total fuel injection quantity (target fuel injection time) is determined to generate the required torque. Based on the injection pattern, a command value (command signal) to the injector 20 is determined. Thereby, a pilot-injection, a pre-injection, an after-injection, and a post-injection are conducted as well as the main-injection according to the driving condition of the vehicle.

The injection pattern is obtained based on a specific map and a correction coefficient stored in the ROM. Specifically, an optimum injection pattern is obtained by an experiment with respect to a range in which the specific parameter is assumed. The optimum injection pattern is stored in an injection control map. The injection pattern is determined by parameters such as a number of fuel injection per one combustion cycle, a fuel injection timing and fuel injection period of each fuel injection. The injection control map indicates a relationship between the parameters and the optimum injection pattern.

The injection pattern is corrected by the correction coefficient which is updated and stored in the EEPROM, and then the injection pattern and the command signal to the injector are obtained. The correction coefficient is sequentially updated during the engine operation.

The injection pattern may be determined based on maps which are independently formed with respect to each element of the injection pattern (for example, the number of fuel injection). Alternatively, the injection pattern may be determined based on a map which is formed with respect to some elements.

Then, the procedure proceeds to step S13. In step S13; the injector 20 is controlled based on the command value (command signal). Then, the procedure is terminated.

The processing shown in FIG. 4 is performed at a specific cycle (for example, a computation cycle of the CPU) or at every specific crank angle. In the processing, the fuel pump 11 is feedback controlled in such a manner that the fuel pressure (inlet pressure) supplied to the injector 20 agrees with the target fuel pressure. In step S21, the computer reads specific parameters, such as the engine speed measured by the crank angle sensor 42, and the target fuel injection quantity (or target total fuel injection quantity) computed in step S12.

In step S22, the computer sets a pressure command value Ptrg as the target fuel pressure based on the parameters which are read in step S21. The pressure command value Ptrg is obtained based on the engine speed and the target fuel injection quantity by use of a specific map stored in the ROM. Specifically, an optimum fuel pressure is obtained by an experiment with respect to a range in which the specific parameter (step S21) is assumed. The optimum fuel pressure is stored in a fuel pressure control map. The fuel pressure map indicates a relationship between the parameters and the optimum fuel pressure.

In step S23, the average value Pave of the output value of a plurality of fuel pressure sensors 20*a* is acquired. This average value Pave is a value computed by processing of FIG. 5 mentioned later. In step S24, the pressure command value Ptrg is compared with the average value Pave.

When the computer determines that the pressure command value Ptrg is larger than the average value Pave in step S24, the procedure proceeds to step S25 in which fuel discharge quantity of the fuel pump 11 is increased. Specifically, a difference between the average value Pave and the pressure command value Ptrg is computed. According to this difference, the driving electric current applied to the SCV 11*c* is adjusted so that the average value Pave comes close to the pressure command value Ptrg by feedback control (for example, PID control).

When the computer determines that the average value Pave is larger than the pressure command value Ptrg, the procedure proceeds to step S26 in which the pressure reducing valve 12*b* is operated to reduce the pressure in the common-rail 12 so that the inlet pressure of the injectors 20 are decreased. Alternatively, the injectors 20 perform no-injection operation to reduce the inlet pressure. In the no-injection operation, the solenoid 20*b* is energized for a short period and the fuel is returned to the fuel tank 10 through the fuel discharge port 21 without performing the fuel injection from the injection port 20*f*.

Specifically, a difference between the average value Pave and the pressure command value Ptrg is computed. According to this difference, the operation period of the pressure reducing valve 12*b* or the no-injection operation period is adjusted so that the average value Pave comes close to the pressure command value Ptrg by feedback control (for example, PID control). When the computer determines that the average value Pave is equal to the pressure command value Ptrg, the procedure is terminated.

The processing shown in FIG. 5 is performed at a specific cycle (for example, a computation cycle of the CPU) or at every specific crank angle. In this processing, a correction of the output value of the fuel pressure sensor 20*a* and a diagnosis process are performed. In step S31, the output values (output voltage) of a plurality of the fuel pressure sensor 20*a* are read.

Figure 6:
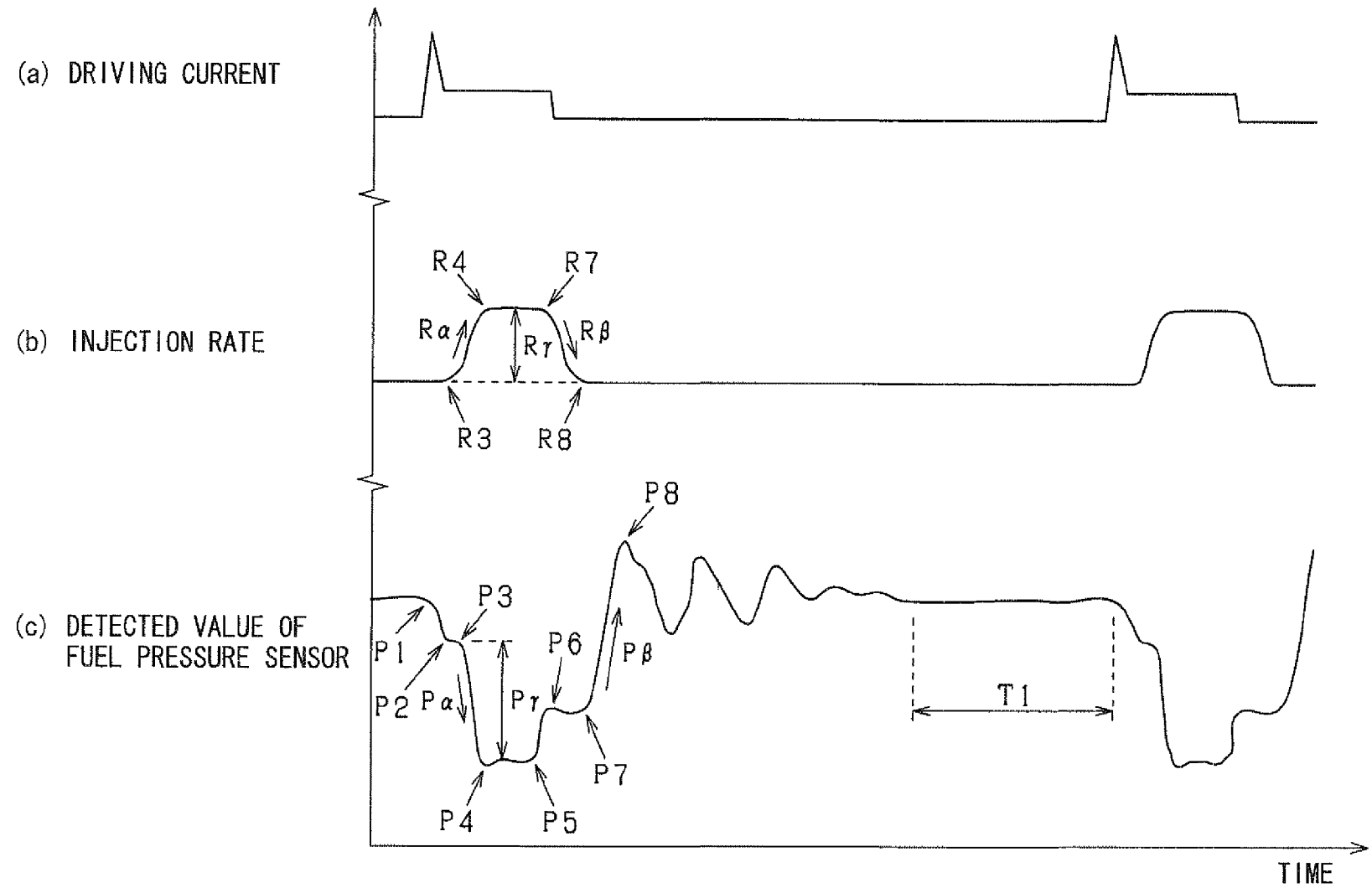
FIG. 6 is a timing chart to show a variation in driving current supplied to a solenoid, a variation in fuel injection rate, and a variation in detected value of a fuel pressure sensor.

Referring to FIG. 6, the processing in step S31 will be described in detail. In FIG. 6, a portion (a) shows a variation in driving current applied to the solenoid 20*b*, which is based on the command signal outputted to the injector 20 in step S13. A portion (b) shows a variation in fuel injection rate, and a portion (c) shows a variation in detected value (output value) of the fuel pressure sensor 20*a*.

The ECU 30 detects the output value of the fuel pressure sensor 20*a* by a sub-routine (not shown). In this sub-routine, the output value of the fuel pressure sensor 20*a* is detected at a short interval so that a pressure waveform can be drawn. Specifically, the sensor output is successively acquired at an interval shorter than 50 μsec (desirably 20 μsec).

The variation in fuel injection rate shown in the portion (b) of FIG. 6 is estimated based on the variation in inlet pressure shown in the portion (c). The estimated injection rate is used for updating the injection control map which is used in step S11. Since the variation in output value of the fuel pressure sensor 20*a* and the variation in injection rate have a relationship described below, the injection rate can be estimated.

After the driving current is applied to the solenoid 20*b*, the detected pressure drops at a point P1 before the injection rate increased at a point R3. This is because the control valve 23 opens the leak hole 24 and the pressure in the oil pressure chamber Cd is decreased at the point P1. When the pressure in the oil pressure chamber Cd is decreased enough, the pressure drop from the point P1 is stopped at a point P2. Then, when the injection rate starts to increase at the point R3, the detected pressure starts to decrease at a point P3. When the injection rate reaches the maximum injection rate at a point R4, the detected pressure drop is stopped at a point P4.

Then, the detected pressure starts to increase at a point P5. This is because the control valve 23 closes the leak hole 24 and the pressure in the oil pressure chamber Cd is increased at the point P5. When the pressure in the oil pressure chamber Cd is increased enough, an increment in the detected pressure from the point P5 is stopped at a point P6. When the injection rate starts to decrease at a point R7, the detected pressure starts to increase at a point P7. Then, when the injection rate becomes zero and the actual fuel injection is terminated at a point R8, the increment in the detected pressure is stopped at a point P8. After the point P8, the detected pressure is attenuated, repeating an increase and a decrease at a constant cycle. After that, the variation width of the detected pressure is within a specific value and the detected pressure value becomes stable during a period T1 (fuel pressure stable period).

As described above, by detecting the points P3 and P8 in the detected pressure, the injection starting point (R3) and the injection terminating point (R8) can be estimated. Based on a relationship between the variation in the detected pressure and the variation in the injection rate, which will be described below, the variation in the injection rate can be estimated from the variation in the detected pressure.

That is, a decreasing rate Pα of the detected pressure from the point P3 to the point P4 has a correlation with an increasing rate Rα of the injection rate from the point R3 to the point R4. An increasing rate Pβ of the detected pressure from the point P7 to the point P8 has a correlation with an decreasing rate Rβ of the injection rate from the point R7 to the point R8. A decreasing amount Pγ of the detected pressure from the point P3 to the point P4 has a correlation with a increasing amount Rγ of the injection rate from the point R3 to the point R4. Therefore, the increasing rate Rα of the injection rate, the decreasing rate Rβ of the injection rate, and the increasing amount Rγ of the injection rate can be estimated by detecting the decreasing rate Pα of the detected pressure, the increasing rate Pβ of the detected pressure, and the decreasing amount Pγ of the detected pressure. The variation in the fuel injection rate shown in the part (b) of FIG. 6 can be estimated.

In step S31, the output value of the fuel pressure sensor 20*a* during the fuel pressure stable period T1 is read, correlating with the pressure command value Ptrg (target fuel pressure) established in step S22 at this time. In a specific fuel pressure sensor 20*a*, it is desirable to detect a plurality of the output values with respect to a single pressure command value Ptrg. It is desirable to use an average value of the output values as the output value of the fuel pressure sensor 20*a* in the processing after step S32. Thereby, an error due to a noise included in a single output value is smoothed. An influence due to the error can be reduced.

In step S32, output characteristic lines indicating a relationship between the output value read in step S31 and the pressure command value Ptrg are computed with respect to a plurality of the fuel pressure sensor 20*a*. The output characteristic lines are denoted by "L1", "L2", "L3", and "L4" in FIG. 7. In this embodiment, the fuel pressure sensor 20*a* has a characteristic in which the output value varies in proportion to the detected pressure. Hence, the output characteristic line can be computed in step S32 based on two data indicating the relationship between the output value read in step S31 and the pressure command value Ptrg.

Figure 7:
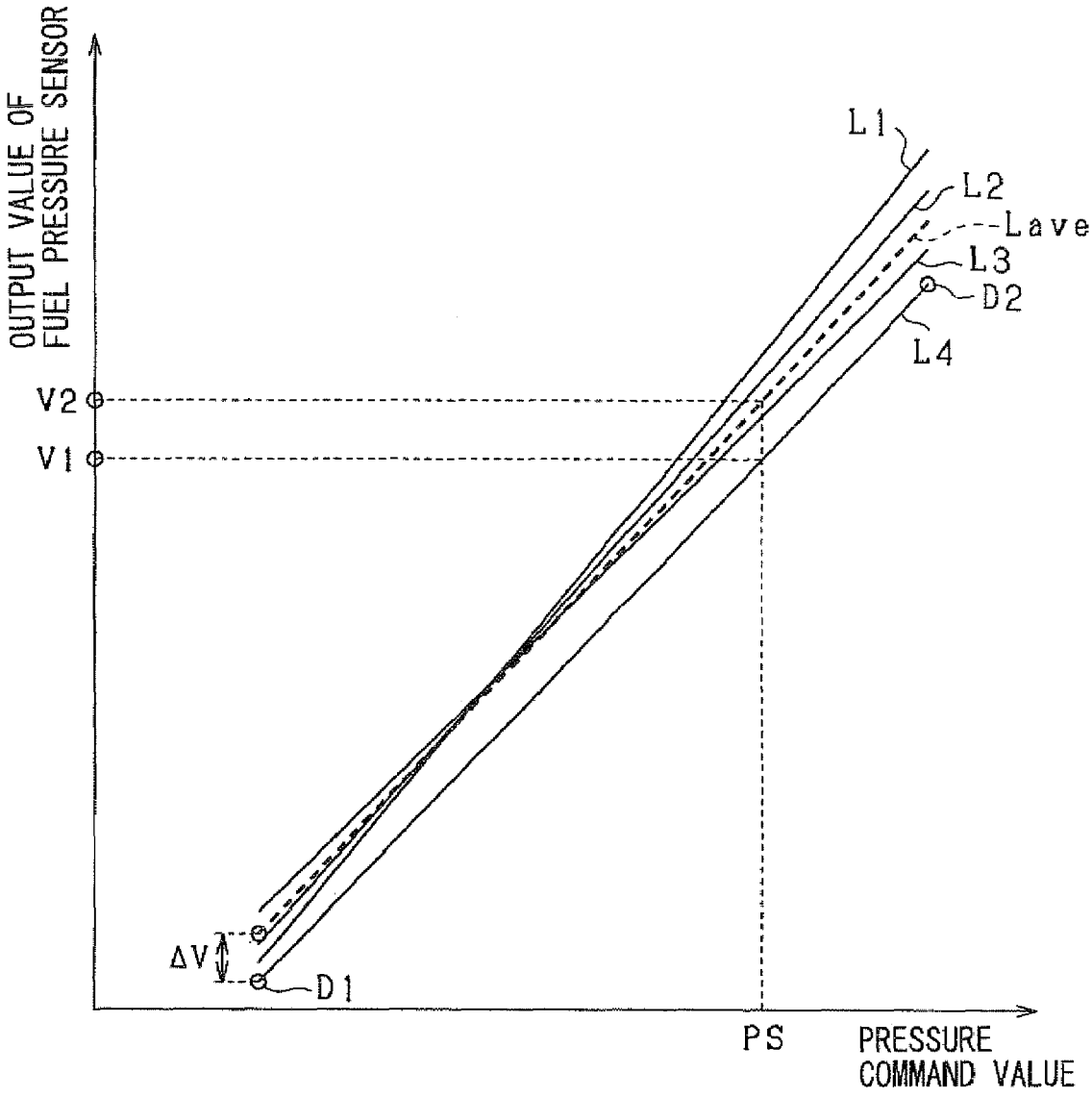
FIG. 7 is a graph to show output characteristic lines which represent relationship between the output value of the fuel pressure sensor and a pressure command value Ptrg.

In FIG. 7, "D1" and "D2" denote two data of the injector 20 (#4). The pressure command value Ptrg at "D1" indicates a pressure command value at a time of engine idle, which is a minimum value. The pressure command value Ptrg at "D2" is a maximum value. With respect to the other injectors 20 (#1, #2, #3), the output characteristic lines are computed in a similar manner. In a case of computing the output characteristic line based on three or more data, a regression line can be computed as the output characteristic line.

In step S33, the computer computes a reference line Lave (refer to FIG. 7) by averaging the output characteristic lines L1, L2, L3 and L4 which are computed in step S32. Specifically, an average of inclination and an average of intercept in the output characteristic lines L1, L2, L3 and L4 are computed, and the line defined by the average inclination and intercept is computed as the reference line Lave. The average value Pave used in step S23 is obtained by inputting any one of output value of the fuel pressure sensors 20*a* into the reference line Lave.

In step S34, a deviation from the reference line Lave is respectively computed with respect to each output characteristic line L1, L2, L3 and L4. The computer determines whether the deviation amount is greater than or equal to a predetermined threshold Δth (refer to FIG. 8). In the output characteristic line L4, with respect to a specific pressure command value (minimum pressure command value at D1 in FIGS. 7 and 8), a difference ΔV between the output value of the output characteristic line L4 and the output value of the reference line Lave is computed as the deviation amount.

Figure 8:
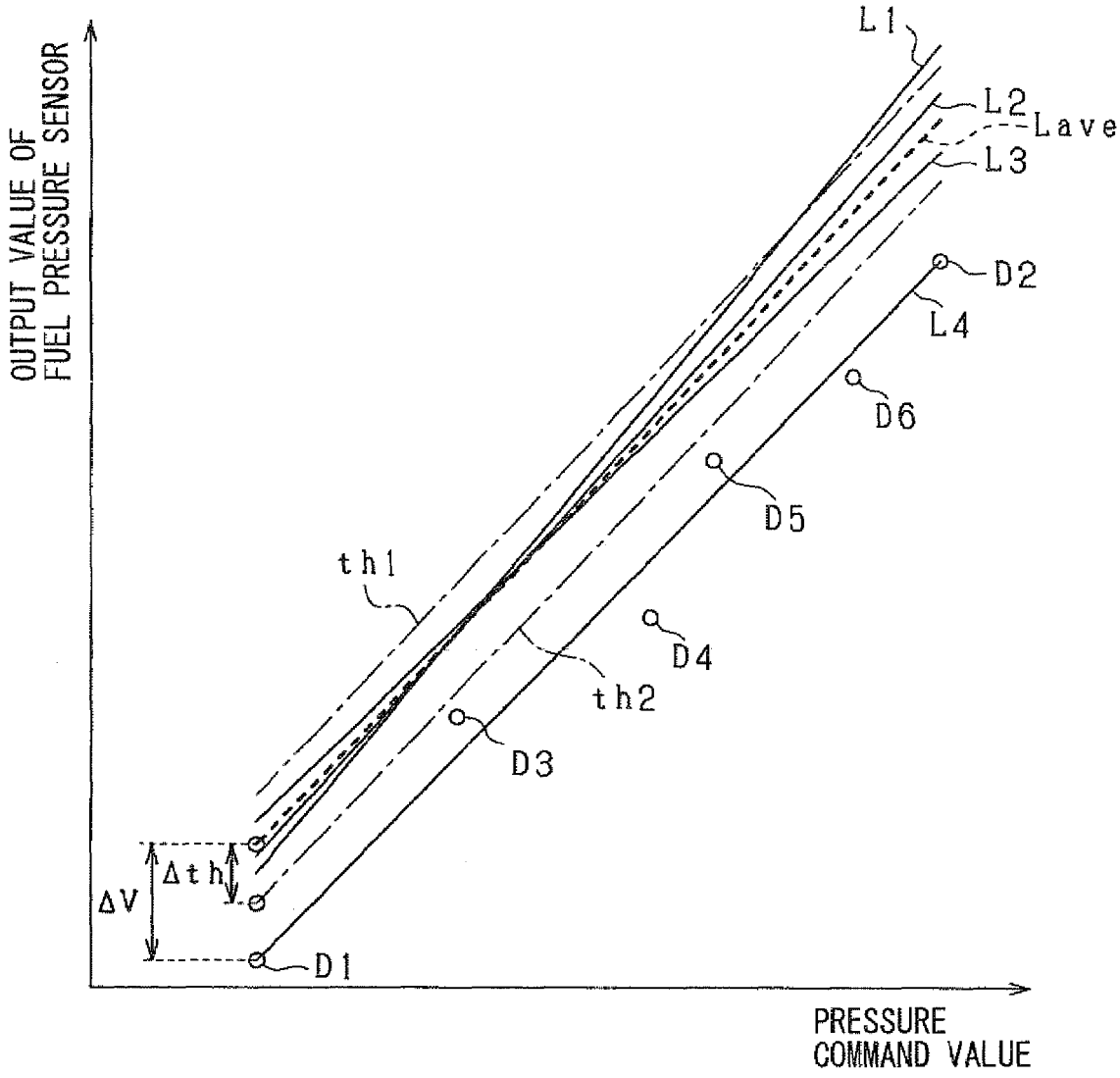
FIG. 8 is a graph to show the output characteristic lines in a case of abnormality determination by the processing shown in FIG. 5.

The specific pressure command value can be maximum pressure command value at D2. Alternatively, the deviation amounts can be computed with respect to both minimum value and maximum value to be compared with the threshold Δth. Alternatively, the deviation amount is computed with respect to all pressure command value, and the maximum deviation amount can be compared with the threshold Δth. In FIG. 8, a line denoted by "th1" is a threshold line of which intercept is added by Δth relative to the reference line Lave, and a line denoted by "th2" is another threshold line of which intercept is reduced by Δth relative to the reference line Lave.

When the answer is Yes in step S34, the procedure proceeds to step S35 in which the computer determines that there is a faulty in the output value of the fuel pressure sensor 20*a* mounted on the cylinder corresponding to the output characteristic line having the deviation amount Δth. The processing in step S35 corresponds to a first abnormality determination means. For example, when the deviation amount ΔV is greater than the threshold Δth in the output characteristic line L4 shown in FIG. 8, it is determined that the output value of the fuel pressure sensor 20*a* provided on the injector 20 of the cylinder #4 is abnormal.

Alternatively, when the output characteristic line is outside of the threshold lines th1, th2 as shown by the line L4, the computer may determine there is abnormality in step S35. Alternatively, when a part of the output characteristic line is outside of the threshold lines th1, th2 as shown by the line L1, the computer may determine there is abnormality in step S35.

When the answer is No in step S34, the procedure proceeds to step S36 in which the output characteristic lines L1, L2, L3 and L4 are corrected to agree with the reference line Lave so that the deviation amount ΔV becomes zero. The processing in step S36 corresponds to an output value correction means. For example, in the output characteristic line L4, the output value V1 of the fuel pressure sensor 20*a* is corrected to the output value V2 in a case that the pressure command value Ptrg is a value of PS. In other words, when the output value of the fuel pressure sensor 20*a* is converted into the pressure, the reference line Lave is used instead of the output characteristic lines L1-L4.

Base on the output value corrected in step S36, the variation in the inlet pressure (a pressure waveform shown in the part (c) of FIG. 6) is acquired. In the output characteristic line L4, the pressure waveform of the cylinder #4 is acquired based on the corrected output value V2. As described above, the injection rate shown in the part (b) of FIG. 6 is estimated, and the injection control map is updated based on the variation in estimated injection rate.

According to this embodiment described above, the following advantage can be obtained.

(1) The fuel pressure sensor 20*a* is provided to each of a plurality of injectors 20. The output characteristic lines L1-L4 of each fuel pressure sensor 20*a* is computed, and the average line of the output characteristic lines L1-L4 is computed as the reference line lave. The deviation amount from an actual value of the reference line lave is smaller than the deviation amount from an actual value of the output characteristic lines L1-L4. The output value of each fuel pressure sensor 20*a* is corrected in such a manner that the output characteristic lines L1-L4 agree with the reference line Lave. Thus, the output value is corrected to come close to the actual value.

Therefore, a robustness of the output value of the fuel pressure sensor 20*a* is improved and the variation in inlet pressure is accurately acquired, whereby the injection rate is accurately estimated. The fuel injection control can be accurately performed based on the estimated injection rate.

(2) The output characteristic lines L1-L4 are computed based on two data "D1" and "D2". The reference line Lave is computed based on the computed output characteristic lines L1-L4, which is used as the average value of the output values of the fuel pressure sensors 20*a*. Since the reference line Lave can be computed based on small number of data, a capacity of the EEPROM can be reduced and a computing load of the CPU can be reduced.

(3) With respect to each output characteristic line L1-L4, when the deviation amount ΔV relative to the reference line Lave is greater than or equal to the threshold Δth, the computer determines that the output value of the corresponding fuel pressure sensor 20*a* is abnormal. Since the reference line Lave can be used as a reference value for diagnosis, the diagnosis can be performed with respect to each fuel pressure sensor 20*a*.

(4) In step S31, the output value during the fuel pressure stable period T1 is read. Since the output characteristic lines L1-L4 are computed by use of the above output value, the deviation amount of the output characteristic lines L1-L4 from the actual value can be made small. The deviation amount of the reference line Lave from the actual value can be also made small. Thus, the corrected output value can be close to the actual value. . . .

(5) The fuel pressure sensor 20*a* is attached to the injector 20. Therefore, compared with the case where the fuel pressure sensor 20*a* is attached to the high pressure piping 14 which connects the common-rail 12 and the injector 20, the fixing position of the fuel pressure sensor 20*a* comes close to the fuel injection port 20*f*. Therefore, compared with the case where the pressure variation is detected after the pressure variation is attenuated in the high pressure piping 14, the pressure variation at the fuel injection port 20*f* can be correctly detected.

Other Embodiments

The present invention is not limited to the above described embodiment.

In the above embodiment, the output characteristic line L4 is computed based on two data "D1" and "D2". Acquiring three or more data "D1"-"D6" (six data in FIG. 8), when the variance values of the data "D1"-"D6" relative to the output characteristic line L4 are greater than a predetermined threshold, the computer may determine that the output value of the corresponding fuel pressure sensor 20*a* is abnormal. This processing corresponds to a second abnormality determination means. That is, if the fuel pressure sensor 20*a* is normal, the data "D1"-"D6" are aligned on a line. On the other hand, if the data "D1"-"D6" are deviated from the output characteristic line L4, the computer can determine that the fuel pressure sensor 20*a* is abnormal.

In step S31, based on the pressure waveform shown in the part (c) of FIG. 6, the computer can determine whether the output value is in the fuel pressure stable condition.

For example, when the variation width of the output value which is obtained at a specific interval (20 μsec) is within a specific width, the computer may determine that it is in the fuel pressure stable condition.

Besides, when the injector 20 does not inject fuel, (for example, when the accelerator pedal is not stepped or the engine is stopped), or when the engine is at idle, the computer may determine that it is in the fuel pressure stable condition. When enough time period has passed after the pressure reducing valve 12*b* is opened, when enough time period has passed after the fuel pump 11 discharges the fuel, or when enough time period has passed after the injector 20 injects the fuel, the computer may determine that it is in the fuel pressure stable condition.

The fuel pressure stable condition is compulsorily established and the output value of the fuel pressure sensor 20*a* is read at this time. That is, in the above embodiment, the target fuel pressure (pressure command value) is established based on the engine speed and the target fuel injection quantity. The target fuel pressure varies constantly, whereby the driving condition of the fuel pump 11 varies and the output value of the fuel pressure sensor 20*a* also varies.

On the other hand, the target fuel pressure is compulsorily fixed at a constant value and the output characteristic lines L1-L4 may be computed by use of the output value which is obtained when the target fuel pressure is compulsorily fixed. With this, since the output characteristic lines L1-L4 are computed by use of the above output value, the deviation amount of the output characteristic lines L1-L4 from the actual value can be made small. The deviation amount of the reference line Lave from the actual value can be also made small. Thus, the corrected output value can be close to the actual value.

When at least one of the first abnormality determination means and the second abnormality determination means determines that there is abnormality in the fuel pressure sensor 20*a*, the reference line Lave can be computed based on the output characteristic lines of the fuel pressure sensors which are normal.

The reference line Lave can be computed every parameters, such as fuel temperature, and the output value of the fuel pressure sensor 20*a* can be corrected every parameters.

In the above embodiment, the output characteristic lines L1-L4 are computed based on two data "D1" and "D2" of each injector 20 (#1-#4), and the reference line lave is computed by averaging the output characteristic lines L1-L4. On the other hand, an average is computed based on the first data (for example, minimum value D1) with respect to each injector 20 (#1-#4). Similarly, an average is computed based on the second data (for example, maximum value D2) with respect to each injector 20 (#1-#4). The reference line Lave can be computed based on the two average values. Thereby, the processing to compute the output characteristic lines L1-L4 can be omitted.

Based on three or more data "D1"-"D6", a regression line can be computed as the output characteristic line.

Each date "D1"-"D6" is corrected and the output characteristic lines L1-L4 can be computed based on the corrected data.

One of the processings in step S36 and step S35 can be omitted.

A piezo-electrically driven injector may be used in place of the electromagnetically driven injector shown in FIG. 2. A fuel injector not causing a pressure leak through the leak hole 24, for example, a direct-acting injector not using the oil pressure chamber Cd so as to transmit a driving power (for example, direct-acting piezoelectric injector that has been developed in recent years) can be also used. When the direct-acting injector is used, the injection rate can be easily controlled.

The fuel pressure sensor can be arranged in the housing 20*e* as indicated by a dashed line with reference numeral 200*a* in FIG. 2. The fuel pressure in the fuel passage 25 can be detected by the pressure sensor 200*a*.

In a case that the fuel pressure sensor 20*a* is arranged close to the fuel inlet 22, the fuel pressure sensor 20*a* is easily mounted. In a case that the fuel pressure sensor 200*a* is arranged in the housing 20*e*, since the fuel pressure sensor is close to the fuel injection port 20*f*, the variation in pressure at the fuel injection port 20*f* can be accurately detected.

The fuel pressure sensor 20*a* can be provided in the high pressure piping 14. In this case, the fuel pressure sensor 20*a* is apart from the common-rail 12 by a specific distance.

Moreover, between the common-rail 12 and the high pressure piping 14, there is provided a flow rate restricting means which restricts flow rate of the fuel which flows into the high pressure piping 14 from the common-rail 12. If an excessive fuel flows out due to a damage of the high pressure piping 14 or the injector 20, the flow rate restricting means closes the passage. The flow rate restricting means includes a ball valve which closes the passage when the excessive fuel flows out. A flow damper having the orifice 12*a* and the flow rate restricting means can be employed.

The fuel pressure sensor 20*a* is provided downstream of the orifice and the flow rate restricting means. Alternatively, the fuel pressure sensor 20*a* can be provided downstream of one of the orifice and the flow rate restricting means.

In the embodiment shown in FIG. 1, a single fuel pressure sensor 20*a* is provided to the fuel passage of a single cylinder. A plurality of the fuel pressure sensor 20*a* can be provided to the fuel passage of a single cylinder.

In the embodiment shown in FIG. 1, the fuel pressure sensor 20*a* is provided to every cylinder. Alternatively, some cylinders may be provided with no fuel pressure sensor 20*a*. Even in this case, it is necessary for a plurality of cylinder to have the fuel pressure sensor 20*a* in order to obtain an average value of the output values.

A rail pressure sensor detecting a pressure in the common-rail 12 can be further provided. With this, the fuel pressure can be detected more accurately.

The kind of the engine to be controlled and the construction of the system can be changed as appropriate according to the use or the like. The present invention can be applied, for example, also to a gasoline engine of a spark ignition type (in particular, direct injection type engine) in the same way. The fuel injection system of a direct injection type gasoline engine is provided with a delivery pipe for storing fuel (gasoline) in a high-pressure state. The fuel is pressure-fed to this delivery pipe from the fuel pump, and the high-pressure fuel in the delivery pipe is delivered to a plurality of the injector 20 and is injected to the combustion chamber of the engine. In this system, the delivery pipe corresponds to an accumulator. The apparatus and the system according to the present invention can be used for the controlling of the fuel injection pressure of not only the fuel injector for directly injecting the fuel into the cylinder but also the fuel injector for injecting the fuel into an intake passage or an exhaust passage of the engine.

What is claimed is:

1. A controller for a fuel injection system which includes an accumulator for accumulating a fuel therein, a plurality of fuel injectors for injecting the fuel accumulated in the accumulator, and a fuel pressure sensor detecting a fuel pressure which varies due to a fuel injection by the fuel injector, the controller controlling the fuel injection system by use of an output value of the fuel pressure sensor, wherein the fuel pressure sensor is provided to each fuel injector respectively and is disposed in a fuel passage between the accumulator and a fuel injection port of the fuel injector so as to be close to a fuel injection port relative to the accumulator, the controller comprising:

an output acquiring means for acquiring output values of a plurality of fuel pressure sensors;

an average computing means for computing an average of the output values; and an output value correction means for correcting the output values in such a manner as to come close to the average.

2. A controller according to claim 1, further comprising a characteristic line computing means for computing an output characteristic line which indicates a relationship between the output value obtained under a various pressure conditions and this pressure condition, wherein the average computing means computes a reference line as the average, which is an average of the output characteristic lines computed with respect to a plurality of the fuel pressure sensors.

3. A controller according to claim 2, wherein the output value correction means corrects the output value in such a manner that the output characteristic line comes close to the reference line.

4. A controller according to claim 1, further comprising a first abnormality determination means for determining that the output value of the fuel pressure sensor is abnormal in a case that a difference between the output value of the fuel pressure sensor and the average is greater than a predetermined threshold.

5. A controller according to claim 1, further comprising:

a characteristic line computing means for computing an output characteristic line which indicates a relationship between the output value obtained under a various pressure conditions and this pressure condition, and a second abnormality determination means for determining that the output value of the fuel pressure sensor is abnormal in a case that a variance value of the output value with respect to the output characteristic line is greater than a predetermined threshold.

6. A controller according to claim 1, further comprising a fuel pressure stable determination means for determining whether it is in a fuel pressure stable condition in which a variation width of the output of the fuel pressure sensor is within a specific width, wherein the average computing means computes the average by use of the output value which is acquired at a time of the fuel pressure stable condition.

7. A controller according to claim 6, wherein the fuel pressure stable determination means determines that it is in the fuel pressure stable condition in a case that a variation width of the output value of the fuel pressure sensor, which is acquired at a specific cycle with respect to a specific fuel pressure sensor, is within the specific width.

8. A controller according to claim 6, wherein the fuel pressure stable determination means determines that it is in the fuel pressure stable condition in a case that the fuel injector does not inject the fuel or an internal combustion engine is at idle.

9. A controller according to claim 1, further comprising a target fuel pressure fixing means for compulsorily fixing a target fuel pressure at a constant value, wherein the average computing means computes the average by use of the output value which is acquired at a time when the target fuel pressure is fixed.

10. A controller according to claim 1, wherein the output acquiring means acquires a plurality of output values of a specific fuel pressure sensor under a substantially constant pressure condition, and the average computing means averages the output values which are acquired with respect to the specific fuel pressure sensor.

11. A controller according to claim 1, wherein the fuel injection system is feedback controlled in such a manner that the average computed by the average computing means comes close to the target fuel pressure for controlling the fuel injection system.

12. A controller for a fuel injection system which includes an accumulator for accumulating a fuel therein, a plurality of fuel injectors for injecting the fuel accumulated in the accumulator, and a fuel pressure sensor detecting a fuel pressure which varies due to a fuel injection by the fuel injector, the controller controlling the fuel injection system by use of an output value of the fuel pressure sensor, wherein the fuel pressure sensor is provided to each fuel injector respectively and is disposed in a fuel passage between the accumulator and a fuel injection port of the fuel injector in such a manner as to be close to a fuel injection port relative to the accumulator, the controller comprising:

an output acquiring means for acquiring output values of a plurality of fuel pressure sensors;

an average computing means for computing an average of the output values, and an abnormality determination means which determines that the output value of the fuel pressure sensor is abnormal when a difference between the output value of the fuel pressure sensor and the average is greater than a predetermined threshold.

* * * * *